US009131778B2

(12) United States Patent
Jin et al.

(10) Patent No.: US 9,131,778 B2
(45) Date of Patent: Sep. 15, 2015

(54) FOLDABLE TENT-COT

(76) Inventors: Ki Ho Jin, Rongshen New (CN); Kwan Jun Choi, Kyongnam (KR)

( * ) Notice: Subject to any disclaimer, the term of this patent is extended or adjusted under 35 U.S.C. 154(b) by 323 days.

(21) Appl. No.: 13/595,015

(22) Filed: Aug. 27, 2012

(65) Prior Publication Data

US 2012/0317717 A1 Dec. 20, 2012

Related U.S. Application Data

(63) Continuation-in-part of application No. 12/518,079, filed on Jun. 5, 2009, now Pat. No. 8,393,023, and a continuation-in-part of application No. 12/817,393, filed on Jun. 17, 2010, now abandoned, and a continuation-in-part of application No. PCT/CN2012/077604, filed on Jun. 27, 2012.

(30) Foreign Application Priority Data

Jan. 11, 2012 (CN) ..... 2012 2 0010694 U

(51) Int. Cl.

| | |
|---|---|
| ***A47C 17/72*** | (2006.01) |
| ***E04H 15/02*** | (2006.01) |
| *A47C 17/76* | (2006.01) |
| *A47C 17/74* | (2006.01) |
| *E04H 15/32* | (2006.01) |

(52) U.S. Cl.

CPC ..... *A47C 17/72* (2013.01); *E04H 15/02* (2013.01); *A47C 17/74* (2013.01); *A47C 17/76* (2013.01); *E04H 15/324* (2013.01)

(58) Field of Classification Search

CPC ..... A47C 7/66; A47C 17/64; A47C 17/68; A47C 17/72; A47C 17/74; A47C 17/76; A47C 29/003; A47C 29/00; E04H 15/02; E04H 15/324; E04H 15/30; E04H 15/38; E04H 15/44; E04H 15/46; E04H 15/48; E04H 15/56

USPC ..... 5/2.1, 110–114, 116, 117, 414, 15; 135/96, 143, 149, 116

See application file for complete search history.

(56) References Cited

U.S. PATENT DOCUMENTS

| | | | | | |
|---|---|---|---|---|---|
| 242,197 | A | * | 5/1881 | Griffith | 5/117 |
| 702,567 | A | | 6/1902 | Kuhn | |
| 729,486 | A | * | 5/1903 | Cantor | 5/117 |
| 1,023,048 | A | | 4/1912 | Snyder | |
| 1,335,456 | A | * | 3/1920 | Nelson | 5/113 |
| 1,374,386 | A | | 4/1921 | Purcell | |
| 1,464,875 | A | | 8/1923 | Hull et al. | |
| 1,985,694 | A | * | 12/1934 | Rosenbaum | 5/117 |

(Continued)

*Primary Examiner* — Nicholas Polito
(74) *Attorney, Agent, or Firm* — John H. Choi

(57) ABSTRACT

A foldable tent-cot includes two elongated rods each having a pair of connecting rods pivotally connected to each other. The foldable tent-cot also includes a pair of outer X-shaped support racks pivotally connected to outer ends of opposing elongated rods and a central X-shaped support rack pivotally connected to central portions of opposing elongated rods. Each X-shaped support rack is defined by a pair of support legs that intersect adjacently at an intersection point and is further supported by support rods. The foldable tent-cot also includes vertical supports connected to the intersection points of each outer X-shaped support rack. A tent is coupled to the elongated rods and to the vertical supports. The integral tent-cot is foldable to a compact state wherein the connecting rods, support rods, X-shaped support racks and vertical supports are collectively folded substantially parallel and adjacent to each other along with the tent.

17 Claims, 17 Drawing Sheets

(56) References Cited

U.S. PATENT DOCUMENTS

| | | | | |
|---|---|---|---|---|
| 2,210,342 | A * | 8/1940 | Sater | 135/140 |
| 2,641,776 | A | 6/1953 | Jensen | |
| 2,841,803 | A | 8/1955 | Bolding | |
| 3,173,156 | A | 3/1965 | Jones | |
| 3,278,953 | A | 10/1966 | Willis | |
| 3,584,322 | A | 6/1971 | McDougall | |
| 3,601,825 | A | 8/1971 | Moorhead et al. | |
| 3,619,827 | A | 11/1971 | Mackenzie | |
| 3,670,750 | A | 6/1972 | Johnston | |
| 3,757,360 | A | 9/1973 | Wescott | |
| 3,848,279 | A | 11/1974 | Ipsen, Jr. | |
| 3,886,609 | A | 6/1975 | MacKenzie | |
| 3,971,495 | A | 7/1976 | Velazquez | |
| 4,086,674 | A | 5/1978 | Chiaradonna | |
| 4,234,005 | A | 11/1980 | Taylor, III | |
| 4,883,206 | A | 11/1989 | Miller | |
| 4,914,768 | A | 4/1990 | Howard | |
| 5,018,227 | A | 5/1991 | Canfield | |
| 5,210,888 | A | 5/1993 | Canfield | |
| 5,449,014 | A | 9/1995 | Yan-ho | |
| 5,489,052 | A * | 2/1996 | Blood, Jr. | 224/156 |
| D372,953 | S | 8/1996 | Florez | |
| 6,062,446 | A | 5/2000 | Daneau | |
| 6,192,909 | B1 | 2/2001 | Strausser | |
| 7,174,584 | B2 | 2/2007 | Danaher | |
| 7,207,077 | B2 | 4/2007 | Hicks | |
| 7,648,196 | B2 * | 1/2010 | Degelman et al. | 297/45 |
| 7,698,756 | B1 * | 4/2010 | Chen | 5/113 |
| 2006/0266399 | A1 | 11/2006 | Ferrari | |

* cited by examiner

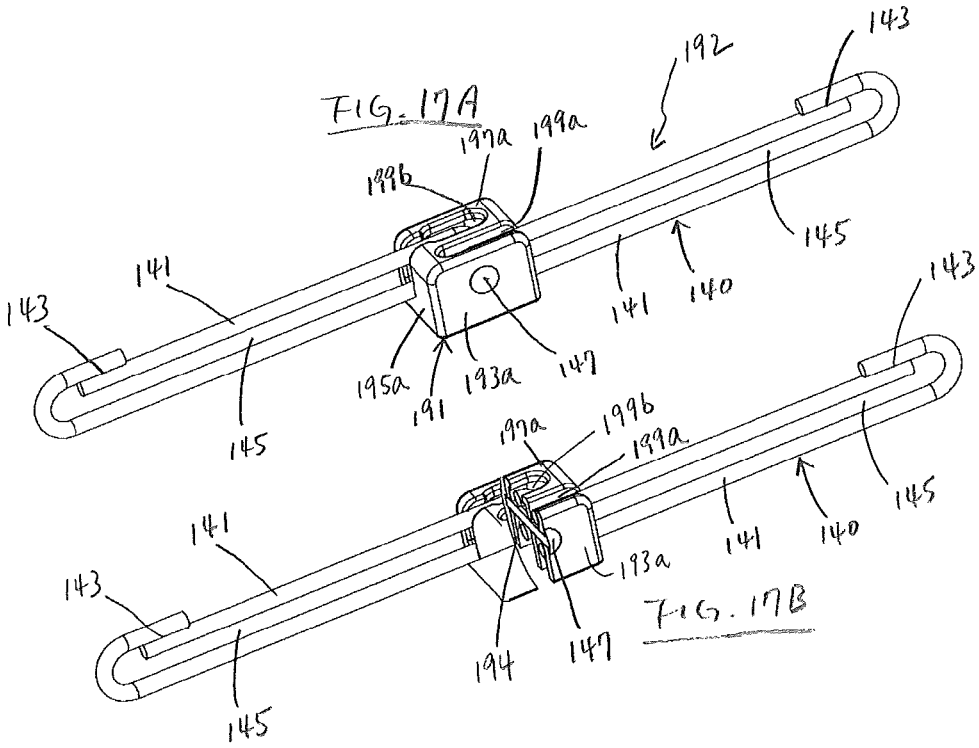
FIG. 17A
FIG. 17B
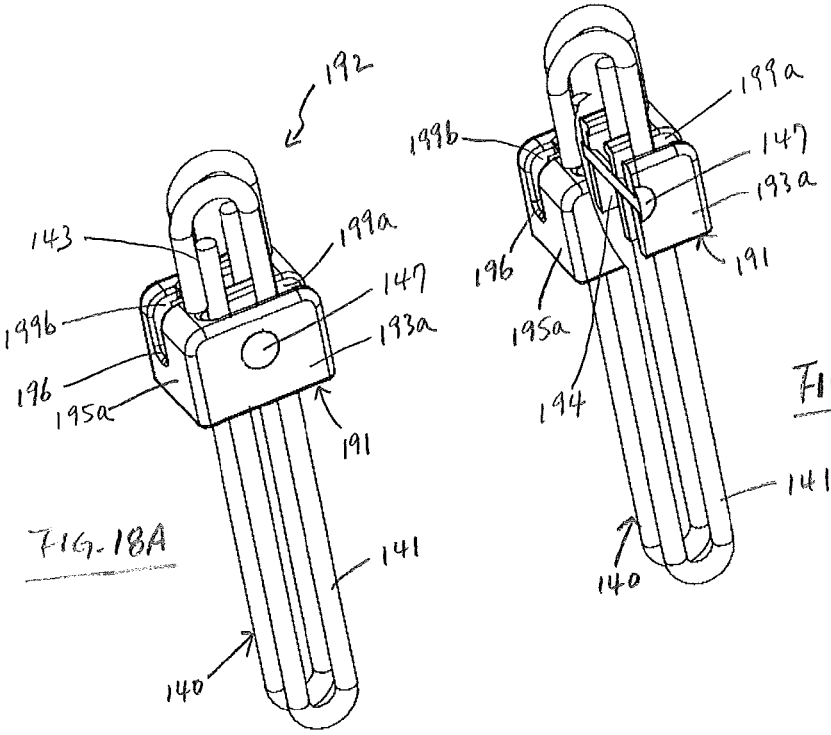
FIG. 18A
FIG. 18B

FOLDABLE TENT-COT

CROSS REFERENCES TO RELATED APPLICATIONS

This application is a continuation-in-part of U.S. patent application Ser. No. 12/518,079, filed on Jun. 5, 2009 now U.S. Pat. No. 8,393,023; a continuation-in-part of U.S. patent application Ser. No. 12/817,393, filed on Jun. 17, 2010 now abandoned; a continuation-in-part of pending PCT Application No. CN2012/77604, filed on Jun. 27, 2012; and also claims priority to and benefit of pending China Patent Application No. 201220010694.3, filed on Jan. 11, 2012, all applications of which are incorporated by reference in their entireties.

BACKGROUND OF THE INVENTION

The present invention relates generally to the temporary shelter, outdoor recreation and camping arts, and more specifically to an integrated foldable tent-cot for use in such environments.

Foldable cots with shelter attachments are known in the art. Conventional cot-shelters include at least two separate components and require multiple steps for assembly. For example, the foldable cot is expanded; an additional shelter frame is assembled on the expanded cot; and the shelter is separately attached to the shelter frame. Thus, assembly is time consuming and assembly could be complicated without detailed assembly instructions.

The use of separate components in conventional cot-shelters in the prior art are also problematic for storage and transport. Specifically, it is difficult to collectively store the components in one location, i.e., a carrying bag, because the multiple components must be separately collapsed and individually inserted into the carrying bag in a compact fashion. This often times requires much effort and time. Moreover, the presence of separate components increases the possibility of loss of parts, especially smaller connection parts such as nuts, bolts and the like.

Therefore, a need exists for a foldable cot with an integrated shelter that requires minimal assembly and disassembly, and that is easy to store.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Briefly stated, the present invention provides a foldable tent-cot comprising: a cot frame comprising two elongated rods each having a pair of connecting rods, each elongated rod having a pair of outer ends and a central portion intermediate thereto, each pair of connecting rods being pivotally connected together at the central portion by a connecting member; a pair of outer X-shaped support racks, each outer X-shaped support rack pivotally connected to opposing elongated rod outer ends; a central X-shaped support rack pivotally connected with opposing connecting members at central portions of the opposing elongated rods, each X-shaped support rack defined by a pair of support legs that intersect adjacently at an intersection point; a tent frame having a pair of vertical supports, each vertical support having a top end and a bottom end, each vertical support connected to each outer X-shaped support rack, top ends of each vertical support having a first coupling member; and a tent having a floor and a plurality of walls extending upwardly therefrom to form an enclosure, the floor fixedly attached to the elongated rods, a pair of second coupling members extending from the walls for coupling to the first coupling members of the vertical supports to form a coupling assembly.

In another aspect, the present invention provides a foldable tent-cot comprising: a pair of elongated rods each having a pair of connecting rods, each elongated rod having a pair of outer ends and a central portion intermediate thereto, each pair of connecting rods being pivotally connected together at the central portion by a connecting member; a pair of outer X-shaped support racks, each outer X-shaped support rack pivotally connected to opposing elongated rod outer ends; a central X-shaped support rack pivotally connected with opposing connecting members at central portions of the opposing elongated rods, each X-shaped support rack defined by a pair of support legs that intersect adjacently at an intersection point; and a pair of vertical supports, each vertical support having a top end and a bottom end, each vertical support connected to each outer X-shaped support rack, top ends of each vertical support having a coupling member.

In yet another aspect, the present invention provides a coupling device for attaching a shelter to a foldable cot, the coupling device comprising: a housing having opposing front and back walls extending between opposing first and second side walls, said walls extending between opposing top and bottom walls; a slot formed on the housing, the slot having opposing inner and outer ends extending between the first and second side walls, wherein the slot inner end partially extends toward the first side wall while fully extending through the top and bottom walls to form an opening, and the slot outer end fully extends through the top wall and an upper portion of the second side wall while partially extending toward the bottom wall, an engaging surface formed below the slot outer end; an aperture extending through a center portion of the back wall, the aperture substantially aligned with the opening; a coupling member housed within the slot, the coupling member having an inner end and an outer end, a channel extending between the inner and outer ends, the outer end having a clip portion for engaging and disengaging the shelter; and a fastener extending through the aperture, opening and channel such that the coupling member is pivotally coupled to the housing.

BRIEF DESCRIPTION OF THE DRAWINGS

To better understand the present invention, a more particular description of the invention will be rendered by reference to the appended drawings.

FIG. 17A is a perspective view of a fifth embodiment of a coupling member of the present invention shown in an engaged state;

FIG. 17B is a partial sectional view of the coupling member shown in FIG. 17A;

FIG. 18A is a perspective view of the coupling member of 17A shown in a disengaged state; and FIG. 18B is a partial sectional view of the coupling member shown in FIG. 18A.

Figure 1:
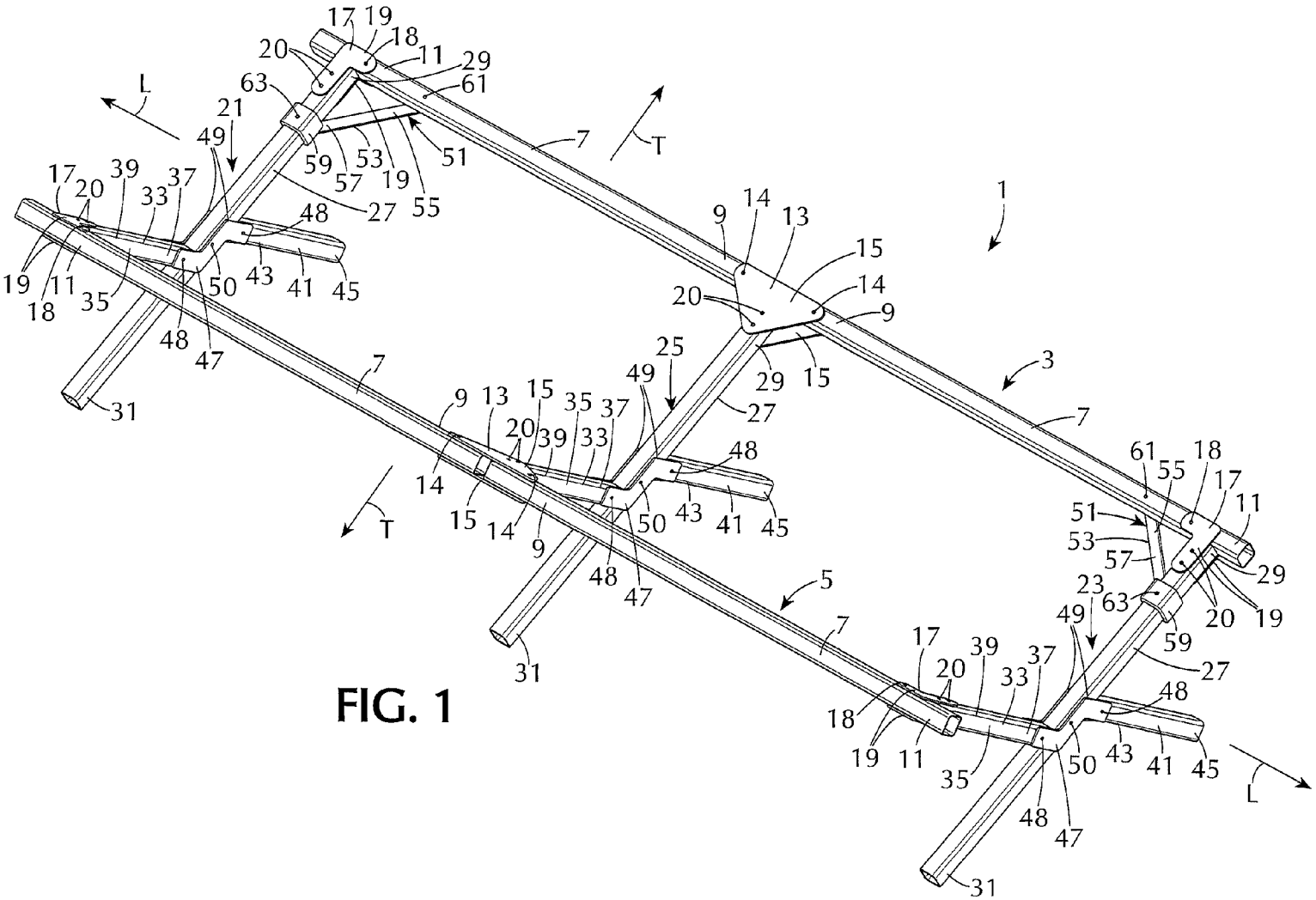
FIG. 1 is a perspective view of an embodiment of a foldable cot frame of the present invention shown in an expanded configuration.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Certain terminology is used in the following description for convenience only and is not limiting. To assist in the description of the present invention, words such as "top," "bottom," "front," "rear," "back," "upper," "lower," "right" and "left" are used to describe the accompanying figures. Also, the article "a" is intended to include one or more items. Where only one item is intended, the term "one" or similar language is used. The terminology includes the words above specifically mentioned, derivatives thereof, and words of similar import.

Referring to the drawings in detail, the foldable tent-cot of the present invention in general includes a cot frame, a tent frame and a tent integral to each other. Descriptions of two separate embodiments of the cot frame are followed by a description of the foldable tent-cot as a whole.

First Embodiment of a Foldable Cot Frame

As shown in FIGS. 1-5, a first embodiment of a foldable bed or cot frame 1 of the present invention is a light-weight structure that is easily foldable from an open position (FIG. 1) to a compact folded position (i.e., closed) (FIG. 5) in three simple steps. Similarly, the bed frame 1 can be fully opened from its closed compact configuration by reversing the steps, as fully described below in further detail.

Figure 2:
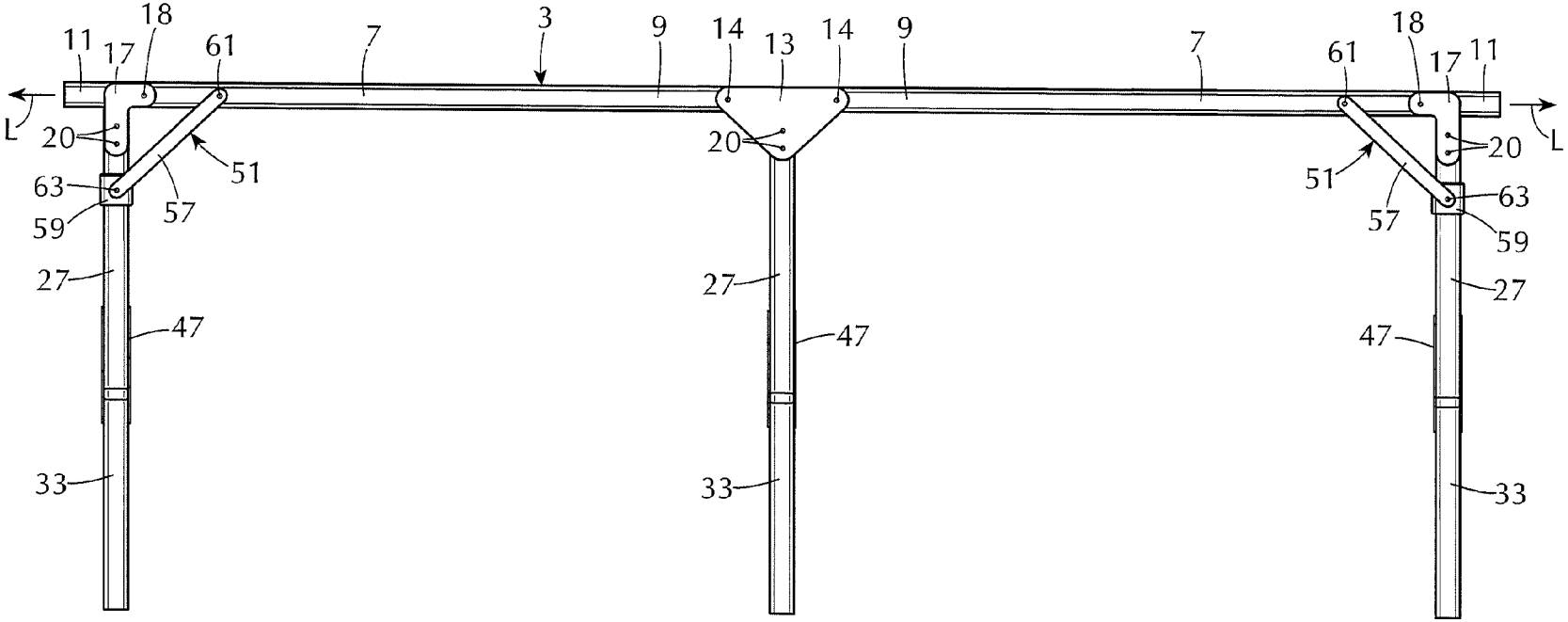
FIG. 2 is a side view of the foldable cot frame of FIG. 1 shown in a partially folded configuration.

Referring to FIGS. 1 and 2, the bed frame 1 is constructed to accommodate a typical rectangular shaped sleeping surface (e.g., canvas linings, among other linings) supported by two sets of opposing longitudinal supports 3, 5. Each longitudinal support 3, 5 includes two longitudinal support extensions 7 having a proximal end 9 and a distal end 11. Although the bed frame in the preferred embodiment is constructed for a typical rectangular support surface, a person of the ordinary skill in the art will appreciate that the length of the support extensions 7 and legs 27, 33 can be modified to accommodate other desired surface areas and shapes.

Referring again to FIGS. 1 and 2, the proximal ends 9 of each pair of the longitudinal support extensions 7 are pivotally attached to an intermediate coupling member 13 to form each longitudinal support 3, 5. Each intermediate coupling member 13 includes two opposing flanges 15 which serve as plates which are sufficiently spaced apart and configured to receive the opposing sides of the proximal ends of the longitudinal support extensions 7. In a preferred embodiment, the flanges 15 of the intermediate coupling members 13 are triangular in shape to receive legs 27, 33 of the third (or intermediate) leg assembly 25 (described in more detail below). However, a person of ordinary skill in the art will appreciate that the shape of the flanges 15 can be configured differently without affecting the function of the intermediate coupling members 13, that is, so long as the flanges 15 can accommodate the longitudinal support extensions 7 as well as the legs 27, 33. For example, the flanges 15 can be T-shaped. Alternatively, the intermediate coupling members 13 can be rectangular in shape if, for example, the third (or intermediate) leg assembly 25 is excluded from the bed frame 1. The support extensions 7 are pivotally secured to the intermediate coupling members 13 via fasteners 14.

As shown in FIGS. 1 and 2, at the distal ends 11 of the longitudinal support extensions 7, end coupling members 17 are pivotally attached for receiving first and second legs 27, 33 of the bed frame 1, which is described in more detail below. The end coupling members 17 are also constructed of two opposing flanges 19 sufficiently spaced apart to receive the legs 27, 33 of the first and second leg assemblies 21, 23. In a preferred embodiment, the flanges 19 are L-shaped to receive the legs 27, 33 therebetween, although such L-shaped configuration is not considered limiting. The end coupling members 17 are attached to the longitudinal support extensions via fasteners 18.

Referring to FIGS. 1 and 2, vertical support for the frame is accomplished by providing at least two but preferably three sets of leg assemblies 21, 23, 25. Each leg assembly includes a first leg 27 and a second leg 33 which cross each other to form an X-shaped support when the bed frame 1 is in the open position. Each first leg 27 is a continuous elongated member having a proximal end 29 and a free end 31. Each second leg 33 consists of an upper member 35 having a proximal end 37 and a distal end 39, and a lower member 41 having a proximal end 43 and a distal end (or second leg free end) 45. In an embodiment, the lengths of the upper member 35 and lower member 41 of the second leg 33 are approximately one-half of the length of the first leg 27. The upper and lower members 35, 41 of the first and second leg assemblies 21, 23 (or outer leg assemblies) are attached to a leg coupling 47 via fasteners 48. The leg coupling 47 is constructed of two opposing flanges 49 spaced apart and configured to receive the upper and lower members 35, 41. In a preferred embodiment, the flanges 49 are S-shaped and the proximal ends of the upper and lower members 37, 43 are attached to each respective end of the S-shaped flange such that the upper and lower members 37, 43 are in parallel alignment. The S-shaped configuration of the flanges 49 is not limiting and can also vary so long as the flanges can accommodate the first and second legs 27, 33. The first leg 27 is pivotally coupled by a fastener 50 (i.e., bolt or rivet) within the flanges 49 between the upper and lower members 37, 43 at a median position along the length of the first leg 27, or an intersection point. The upper and lower members 37, 43 are spaced apart such that the first leg 27 fits snugly between the upper and lower members 37, 43 and in the same plane when the bed frame 1 is in its open position (FIG. 1). This allows for the upper and lower members 37, 43 to maintain a parallel relationship. Thus, the combination of the first and second legs 27, 33 form an X-shaped vertical support for the foldable bed frame 1. Alternatively, the second leg 33 can be one continuous member (instead of having an upper member and lower member joined by a leg coupling) and pivotally coupled adjacent to the first leg 27 at an intersecting point to form an X-shaped vertical support.

Figure 5:
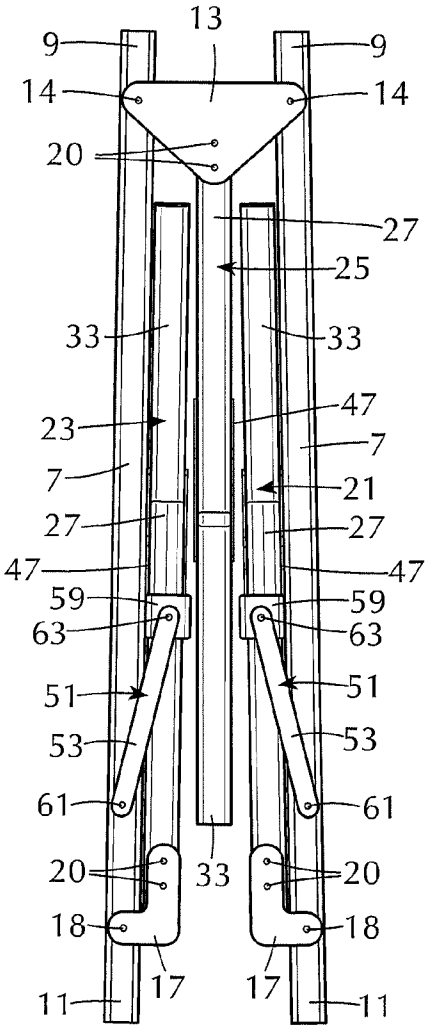
FIG. 5 is a side view of the foldable cot frame of FIG. 1 shown in a fully folded configuration.

Referring again to FIGS. 1 and 2, the proximal ends 29 of the first legs 27 of the first and second leg assemblies 21, 23 are fixedly coupled to the end coupling members 17 of the first longitudinal support 3 via fasteners 20. Similarly, the second leg upper member distal ends 39 of the first and second leg assemblies 21, 23 (or second leg proximal end 39) are fixedly coupled to the end coupling members 17 of the second longitudinal support 5 via fasteners 20. The first and second leg assemblies 21, 23 are positioned perpendicular to the first and second longitudinal supports 3, 5 when the bed frame 1 is in the open position (FIG. 1) and are positioned parallel to the first and second longitudinal supports 3, 5 when the bed frame 1 is folded in the fully folded or closed position (FIG. 5). Similarly, the first leg proximal end 29 and the second leg upper member distal end 39 of the third leg assembly 25 (or the third leg proximal end 29 and the fourth leg upper member distal end 39 of the intermediate leg assembly 25) are fixedly coupled to the intermediate coupling members 13 of the first longitudinal support 3 and the second longitudinal support 5, respectively, via fasteners 20. The third (or intermediate) leg assembly 25 is positioned perpendicular with respect to the first and second longitudinal supports 3, 5 in either the open or closed positions of the bed frame 1 (FIGS. 1, 5). The third (or intermediate) leg assembly 25 can optionally be attached to the intermediate coupling members 13 to provide additional vertical support proximate the central portion of the bed frame 1.

As shown in FIGS. 1 and 2, in accordance with the present invention, a pair of brace members 51 are provided for additional lateral support. Each brace member 51 includes a brace 53 having a proximal end 55 and a distal end 57. The proximal end 55 is pivotally coupled via fastener 61 to the longitudinal support extension distal ends 11 of the first longitudinal support 3. The distal end 57 is pivotally coupled via fastener 63 to a sleeve 59 which is slidingly coupled to the first leg 27. The brace members 51 provide additional lateral stability for the bed frame 1 along the transverse direction "T," as well as the longitudinal direction "L" of the bed frame 1. The foldable bed frame 1 can be equipped with a permanent cover that is stitched or otherwise fastened around the support extensions 7 of opposing longitudinal supports 3, 5. The fabric covering (not shown) provides lateral support in the transverse direction along the bed frame, however, the stitching or fasteners and the cover itself is susceptible to lateral stresses and undesired wear-and-tear, especially when a user lies down on the covering of the bed structure. To alleviate or otherwise minimize the excessive lateral forces, the brace members 51 provide additional lateral support to the bed frame 1 and prevent unnecessary stress or wear and tear on the cover stitching or fasteners by restricting the lateral movement of the bed frame 1 by a user. In other words, the braces 51 absorb most, if not all of the lateral forces instead of the fabric covering itself. In an embodiment where the foldable bed frame 1 is not provided with permanent covers, but is instead constructed for use with a separate detachable mattress, the brace members 51 provide the transverse lateral support necessary for preventing the bed frame 1 from extending beyond the desired open position. That is, the transverse movement of the longitudinal supports 3, 5 are limited by the length and positioning of the brace 53 with respect to the first and second leg assemblies 21, 23 because the sleeve 59 cannot move beyond the desired open position due to geometrical constraints created by the length of the brace 53. This geometrical constraint formed by the connection of the brace members 51 between the longitudinal support 3 and first leg 27 also limits lateral movement along the longitudinal direction "L," thus providing additional stability to the bed frame 1 in the longitudinal direction. Furthermore, each sleeve 59 of the brace members 51 provides a guide for the bed frame 1 during the folding process (described in more detail below).

In a preferred embodiment, the longitudinal support extensions and legs of the bed frame are constructed of light-weight steel and have a rectangular cross-section. The longitudinal support extensions and legs are preferably tubular which reduces the overall weight of the structure while maintaining the strength of the structure. Alternatively, the longitudinal support extensions and legs can be constructed of other materials such as high-strength plastic, composite material, aluminum, other light-weight alloys or combinations thereof, and can have other cross-sectional configurations (e.g., circular shape) without affecting the overall integrity of the structure. Additionally, the fasteners are preferably rivets, however, other fastener types such as nuts and bolts, screws, or other fasteners can be used to achieve the same objective.

Figure 3:
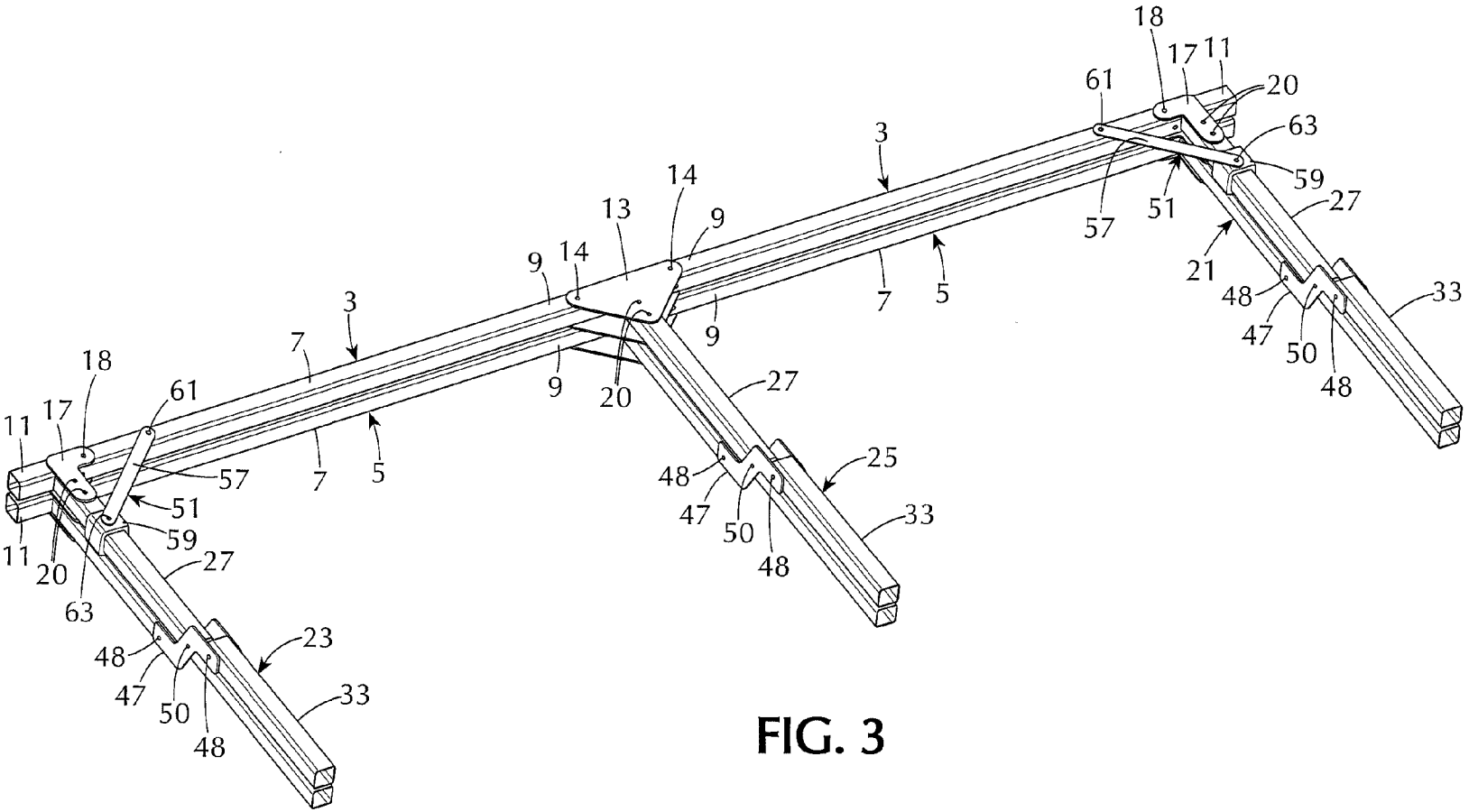
FIG. 3 is a perspective view of the foldable cot frame in the partially folded configuration shown in FIG. 2.
Figure 4:
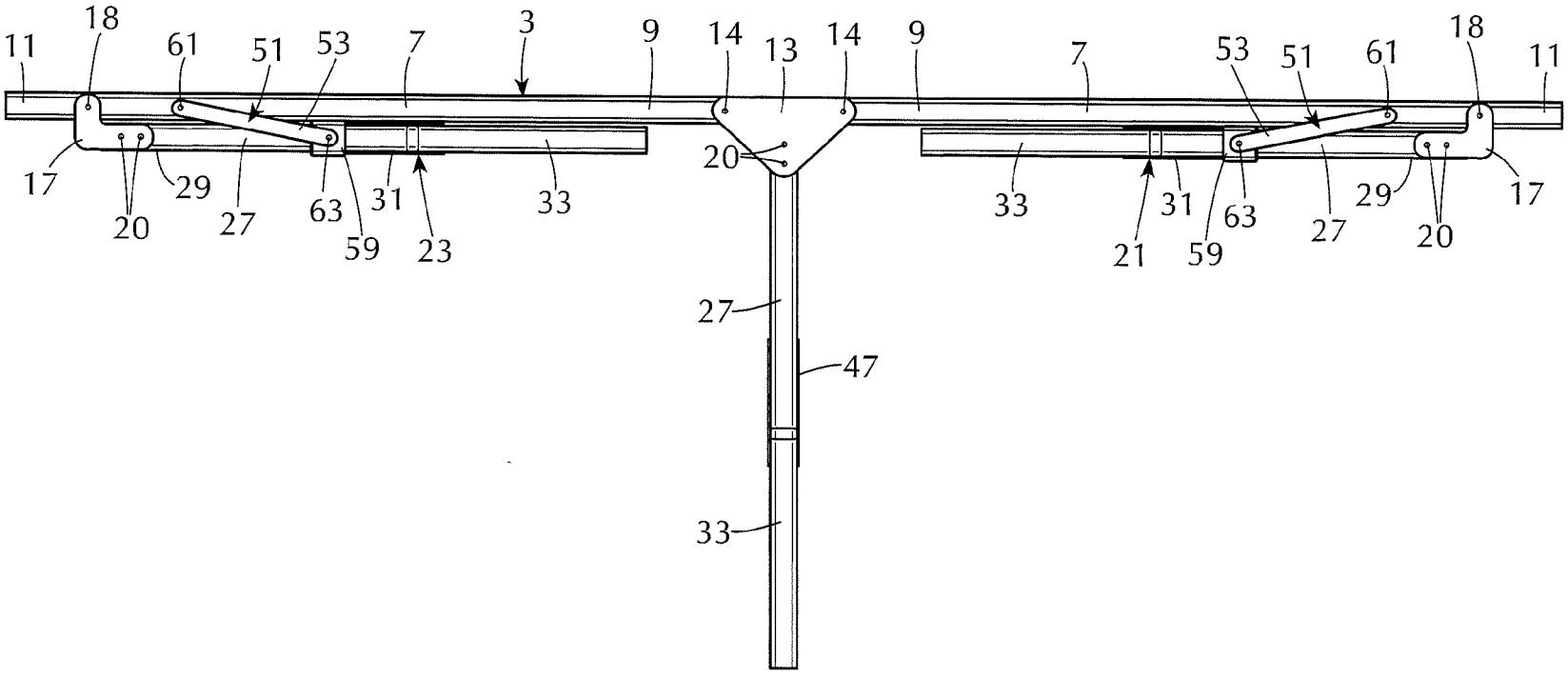
FIG. 4 is a side view of the foldable cot frame of FIG. 1 shown in another partially folded configuration.

Referring to FIGS. 1-5, in operation, a three-step process is implemented to fold the bed frame from the open position (FIG. 1) to a fully folded (closed) position (FIG. 5). Referring to FIGS. 2 and 3, the first and second longitudinal supports 3, 5 are pushed together in the transverse direction "T" until the longitudinal supports 3, 5 are side-by-side. During this closing process, the first and second legs 27, 33 also become positioned side-by-side while remaining in the same plane, such that each half of the bed frame structure pivots about the fasteners 50 of the leg couplings 47. Referring to FIG. 4, the first and second leg assemblies 21, 23 are folded inward towards the longitudinal direction "L" until they are positioned side-by-side (i.e., parallel) with the first and second longitudinal supports 3, 5. During this folding step, each of the leg assemblies 21, 23 pivots inwardly about the fastener 18. As the leg assemblies 21, 23 pivot inward, each sleeve 59 also slides from the first leg proximal end 29 in a direction towards the first leg free end 31 as the brace 53 pivots inward about the fastener 61. Referring to FIG. 5, each side of the leg assembly 21, 23 and longitudinal support extension 7 is further folded inwardly in the longitudinal direction "L" by pivotably rotating the distal ends 9 about the fasteners 14 extending through the intermediate coupling members 13 until the bed frame 1 is in a fully folded position. In this fully folded or closed position, the folded first and second leg assemblies 21, 23 are positioned parallel each other on opposing sides of the third (or intermediate) leg assembly 25.

Therefore, the foldable cot frame 1 of the present invention provides a low-cost, lightweight foldable bed frame with improved lateral stability of the bed frame—in the transverse direction as well as the longitudinal direction of the bed frame—using minimal components for construction which is can be easily opened and folded.

Second Embodiment of a Foldable Cot Frame

Figure 6:
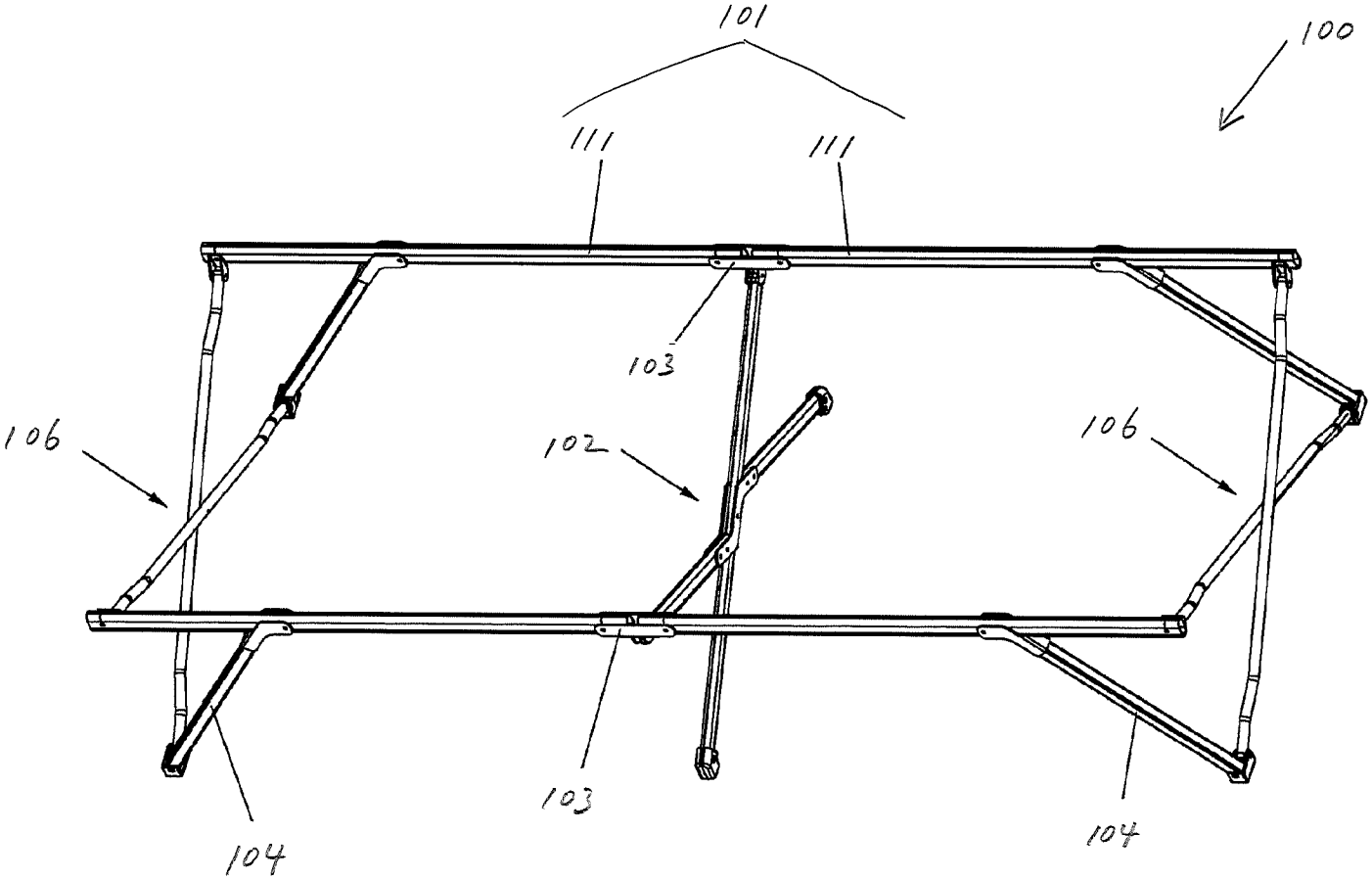
FIG. 6 is a perspective view of another embodiment of a foldable cot frame of the present invention shown in an expanded configuration.
Figure 7:
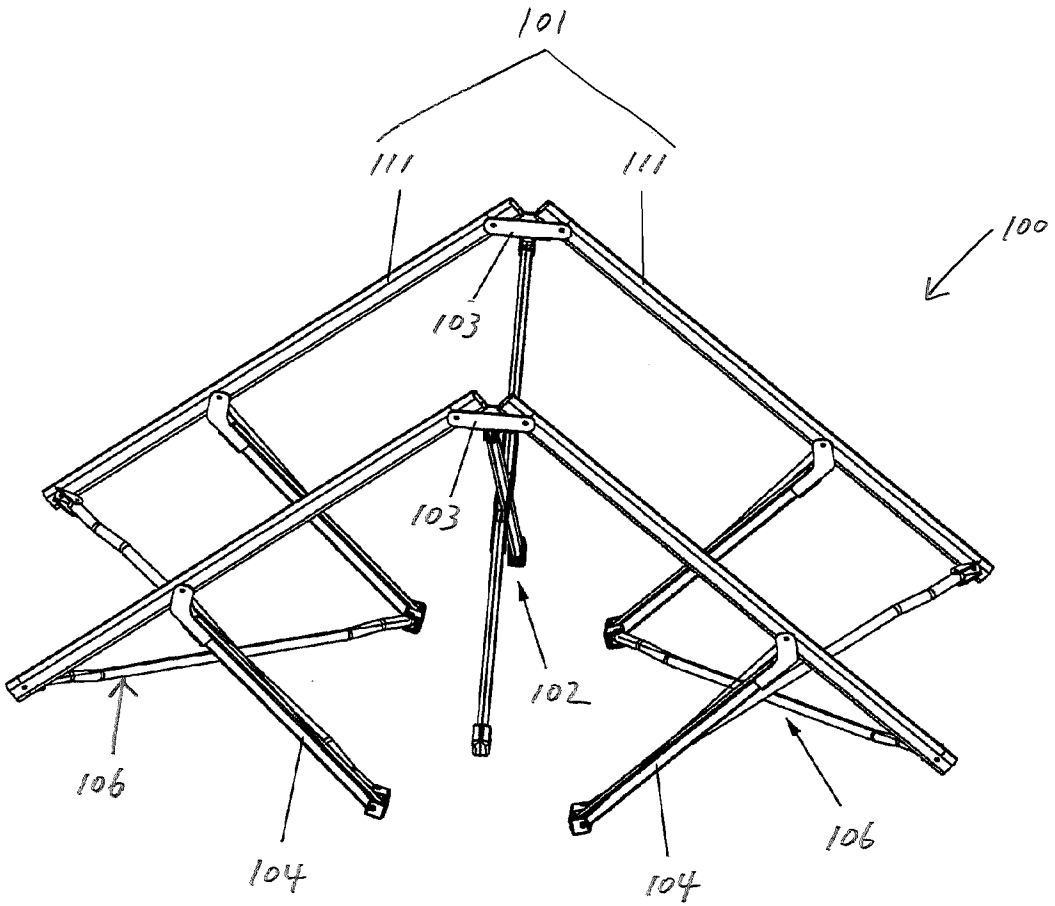
FIG. 7 is a perspective view of the foldable cot frame of FIG. 6 shown in a partially folded configuration.
Figure 8:
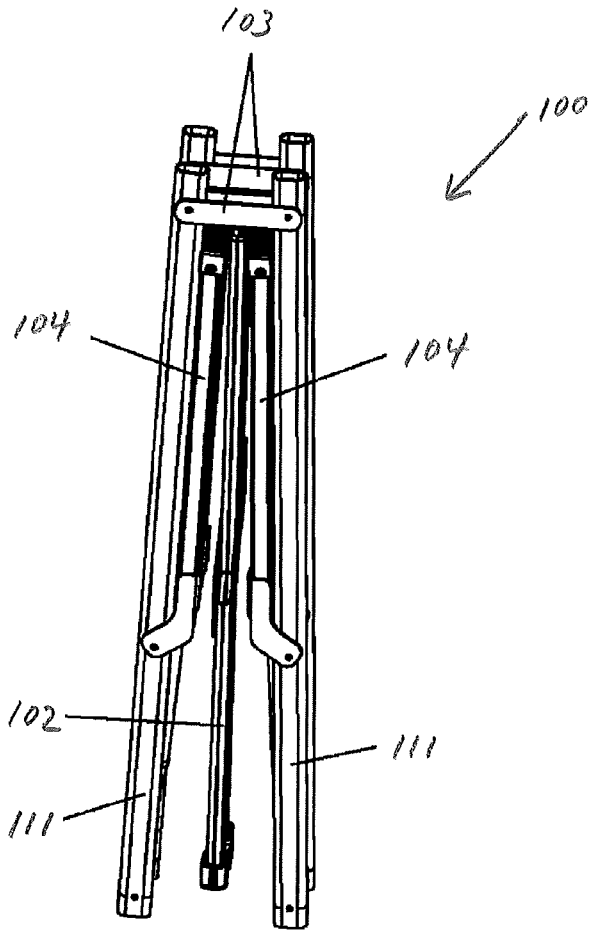
FIG. 8 is a perspective view of the foldable cot frame of FIG. 6 shown in a fully folded configuration.

As shown in FIGS. 6-8, a second embodiment of a collapsible or foldable cot frame 100 of the present invention comprises two elongated rods 101 and plurality of X-shaped support racks 102, 106 under the two elongated rods 101. Each of the two elongated rods 101 is composed of two connecting rods 111 connected together. Each of the two connecting rods 111 has an inner end pivotally connected to a connecting member 103 so that the two connecting rods 111 are connected together. Each of the two elongated rods 101 has two ends and a central portion pivotally connected with an outer X-shaped support rack 106 and a central X-shaped support rack 102, respectively. The central X-shaped support rack 102 is pivotally connected to the connecting members 103. The difference between the present collapsible cot frame 100 and the prior art is that support rods 104 are provided between the two ends of the elongated rods 101 and the outer X-shaped support racks 106, respectively, forming an outer leg assembly. When the foldable cot frame 100 is expanded, the support rods 104 will support the outer X-shaped racks 106 securely. In addition, the support rods 104 assist the outer X-shaped support racks 106 in expanding or collapsing.

As shown in FIG. 7, when the cot frame 100 is collapsed, the central portion of the elongated rods 101 are lifted upward and inward, and the two connecting rods 111 are folded downward. The support rods 104 are brought to move inward. During the collapse, the bottoms of the outer X-shaped support racks 106 are pulled inward. Referring to FIG. 8, when the connecting rods 111 are collapsed, the outer X-shaped support racks 106, the support rods 104, the connecting rods 111 and the central X-shaped support rack 102 are adjacent and substantially parallel to each other. Referring to FIG. 6, when the collapsible cot frame 100 is expanded, the connecting rods 111 will be pulled upward and the support rods 104 will push the outer X-shaped racks 106 to prop up automatically. According to the aforesaid, the support rods 104 are adapted to assist in pulling or pushing the outer X-shaped racks 106 for expanding or collapsing the collapsible cot frame 100 with ease.

Foldable Tent-Cot

Figure 9:
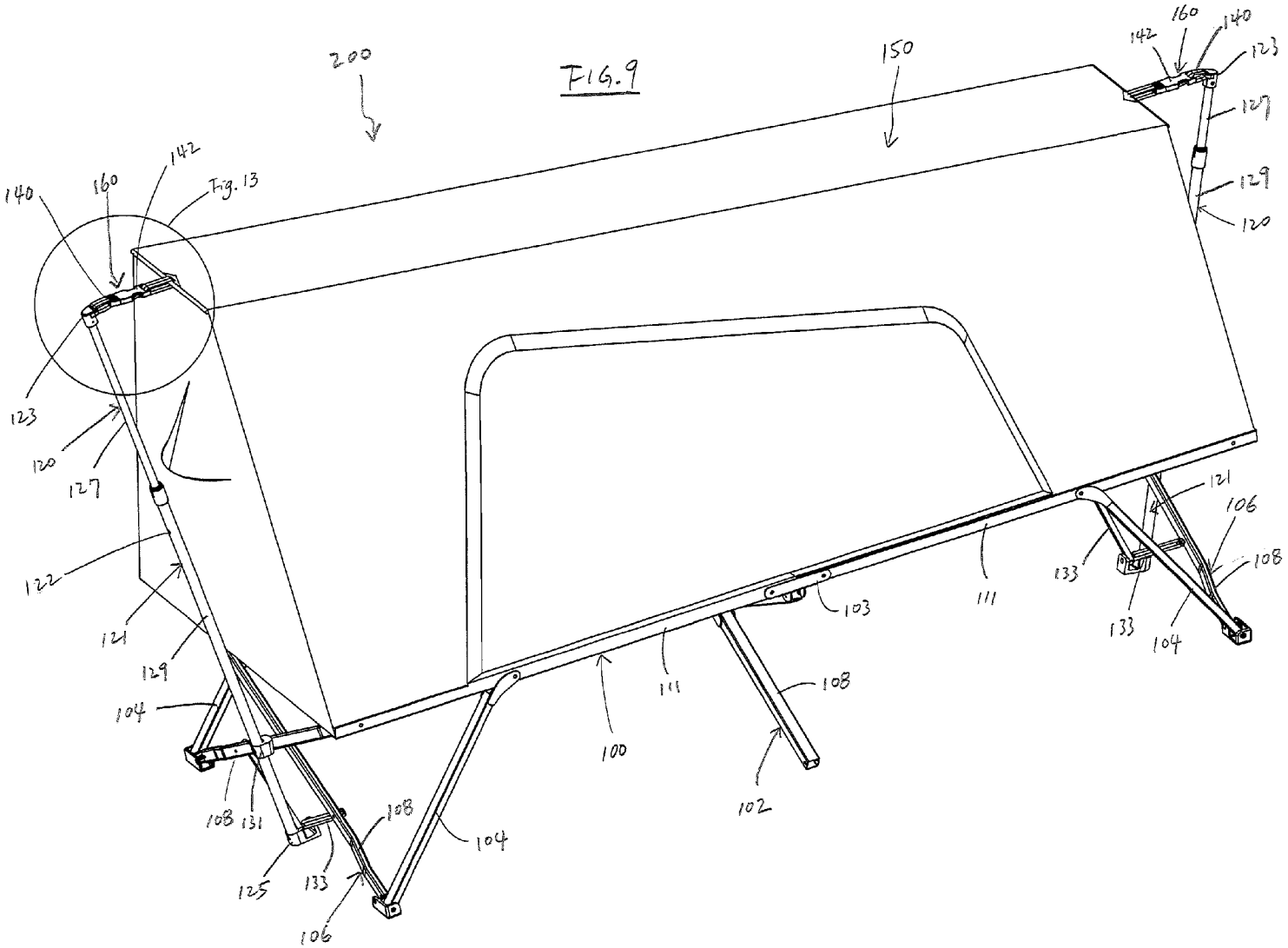
FIG. 9 is a perspective view of an embodiment of a foldable tent-cot of the present invention shown in an expanded configuration with a first embodiment of a coupling assembly of the present invention.
Figure 10:
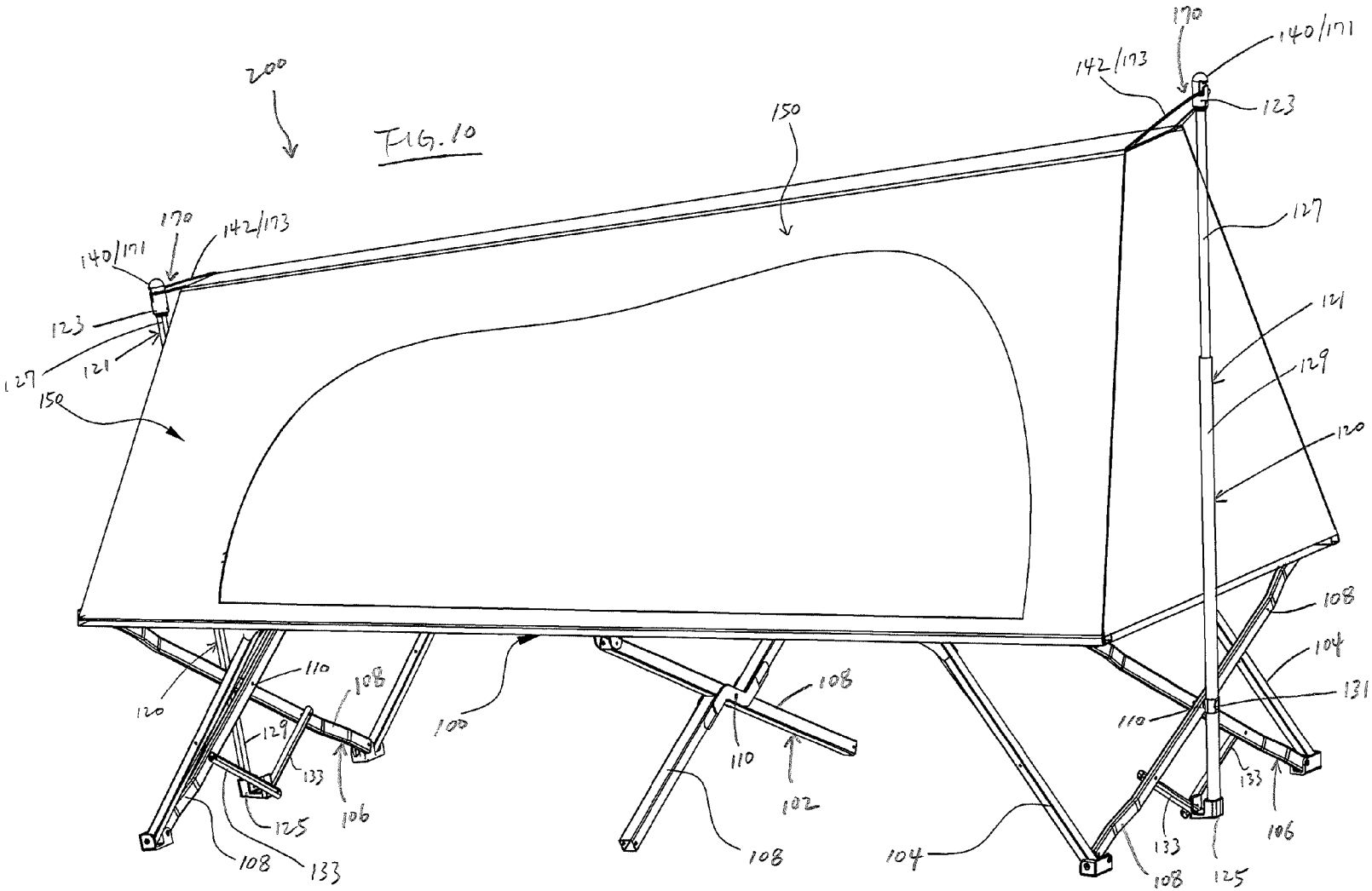
FIG. 10 is a perspective view of the foldable tent-cot of FIG. 9 with a second embodiment of a coupling assembly of the present invention.
Figure 11:
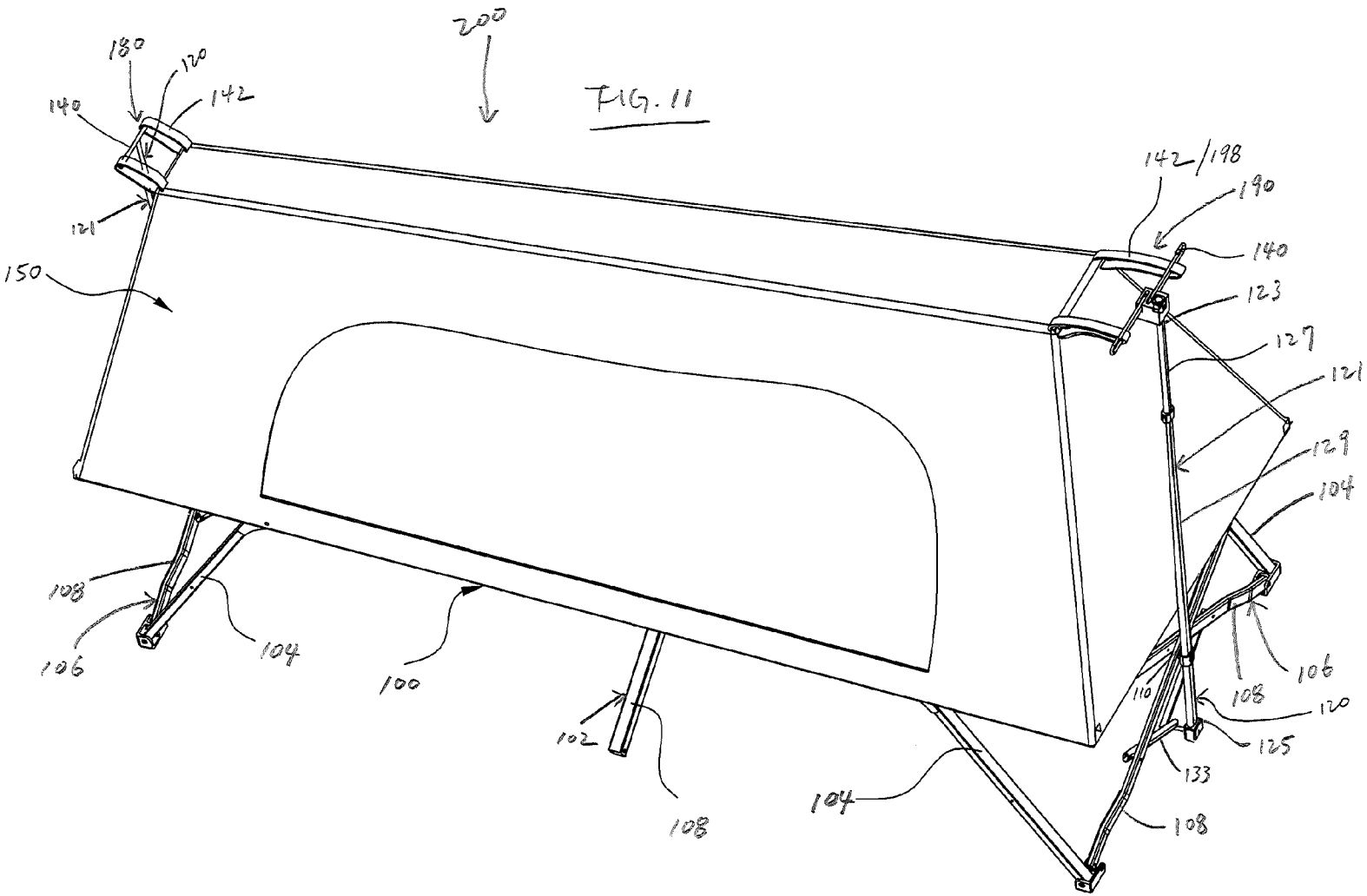
FIG. 11 is a perspective view of the foldable tent-cot of FIG. 9 with third and fourth embodiments of a coupling assembly of the present invention.

Referring to FIGS. 9-11, a tent-cot 200 of the present invention is illustratively shown with several embodiments of a coupling assembly of the present invention. The tent-cot 200 is illustratively shown with the foldable cot frame 100 of the second embodiment, which is shown in FIGS. 6-8 and described in detail above. However, the foldable cot frame 1 of the first embodiment, shown in FIGS. 1-5 and described in detail above, could also be used for the tent-cot 200.

Referring again to FIGS. 9-11, in general, the foldable cot frame 100 includes two elongated rods 101. Each elongated rod 101 includes a pair of outer ends and a central portion intermediate thereto. Each elongated rod 101 includes a pair of connecting rods 111 with each pair of connecting rods 111 being pivotally connected together at the central portion by a connecting member 103. The foldable cot frame 100 also includes a pair of outer X-shaped support racks 106 with each outer X-shaped support rack 106 pivotally connected to opposing elongated rod 101 outer ends. A central X-shaped support rack 102 is pivotally connected with opposing connecting members 103 at central portions of the opposing elongated rods 111. Each X-shaped support rack 102, 106 is defined by a pair of support legs 108 that intersect adjacently at an intersection point 110. In the preferred embodiment, the pair of support legs 108 of each X-shaped support rack 102, 106 are pivotally coupled at each respective intersection point 110. However, the support legs 108 of the outer X-shaped support racks 106 could be disconnected from each other. The foldable cot frame 100 also includes support rods 104 having a proximal end and a distal end. The proximal end of each support rod 104 is pivotally connected to the elongated rods 111 and the distal ends of the each support rod 104 is pivotally connected to a corresponding outer X-shaped support rack 106. In the preferred embodiment, each support rod 104 distal end is connected to a lower end of a corresponding outer X-shaped support rack 106.

Figure 12:
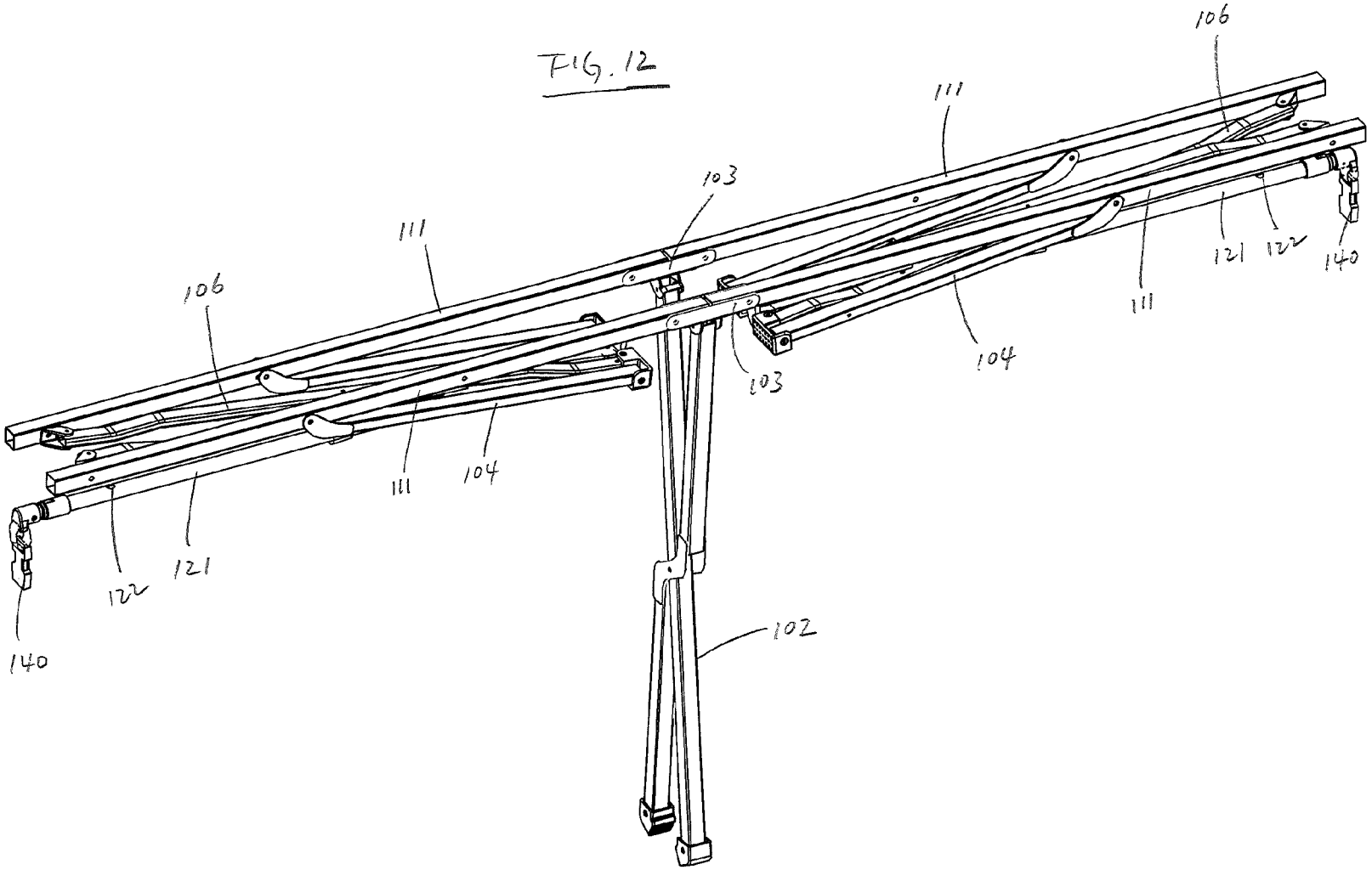
FIG. 12 is a perspective view of a frame portion of the foldable tent-cot of FIG. 9 shown in a partially folded configuration.

Referring again to FIGS. 9-11, the tent-cot 200 also includes a tent frame having a pair of vertical supports 121. Each vertical support 121 includes a top end 123 and a bottom end 125. The vertical supports 121 could be substantially vertically upright (as shown in FIGS. 10 and 11) or at an angle (as shown in FIG. 9) as desired. In the preferred embodiment, each vertical support 121 includes two telescopically retractable sections 127, 129 which are coupled by conventional methods. For example, the first section 127 includes a spring loaded detent pin (not shown) for indexing in a hole 122 (as shown in FIGS. 9 and 12) provided in the second section 129 for locking the sections 127, 129 in an extended position, and depressing the detent pin to disengage the aperture 129 to unlock and retract the first section 127 (as shown in FIG. 12). One of ordinary skill in the art will recognize that more than two retractable sections or a plurality pivotally attached foldable sections could be used without departing from the spirit and scope of the present invention. Each vertical support 121 is connected to each outer X-shaped support rack 106 at the intersection point 110, and in the preferred embodiment, a coupling sleeve 131 is fixed to the intersection point 110 such that the vertical support 121 is slidable within the coupling sleeve 131. Alternatively, if the support legs 108 of each outer X-shaped support rack 106 are disconnected, the coupling sleeve 131 is connected only to the outermost support leg 108. When the tent-cot is constructed with the first cot frame 1, shown for example in FIG. 1, the coupling sleeves 131 are pivotally fixed to the fasteners 50 of the first and second leg assemblies 21, 23. Bottom ends of each vertical support 121 include a pair of braces 133 having a first end and a second end. The first ends of each brace 133 is pivotally connected to the bottom end of the vertical support 121 and the second ends of each brace 133 is pivotally connected to opposing support legs 108 of a corresponding outer X-shaped support rack 106 to provide additional support to the vertical support 121. However, the tent frame 120 could be constructed without the braces 133 such that the bottom end of the vertical support 121 is extended to and supported by a ground surface. Top ends of each vertical support 121 include a first coupling member 140 for coupling the vertical support 121 to a tent portion, which is described in more detail below. The overall frame assembly formed by the foldable cot frame 100 and the tent frame 120 provides a one-piece integral structure for the tent-cot 200 which is not available in the prior art.

Referring again to FIGS. 9-11, the tent-cot 200 also includes a tent 150 having a floor (not shown) and a plurality of walls extending upwardly therefrom to form an enclosure. In the preferred embodiment, the tent 150 includes a ceiling to provide additional space within the interior of the tent 150 but the tent 150 could be constructed without the ceiling and could be constructed of different shapes and sizes. The floor is fixedly attached to the elongated rods 101, preferably by overlapping a periphery of the floor around each elongated rod 101 and sewing the overlapped portion together, which is described above in more detail with respect to the first embodiment of the foldable cot frame. An additional support surface, such as an air mattress, could be separately used or integrally formed on the floor portion. A pair of second coupling members 142 extends from the walls for coupling to the first coupling members 140 of the vertical supports 121 to form a coupling assembly. The second coupling members 142 are preferably attached to seams of the tent and further reinforced with heat welding, woven polyester webbing or both so that any tension on the second coupling members 142 is sufficiently absorbed without damaging the tent 150. The overall assembly of the foldable cot frame 100, tent frame 120 and tent 150 provides a one-piece integral structure for the tent-cot 200 which is not available in the prior art.

Figure 13:
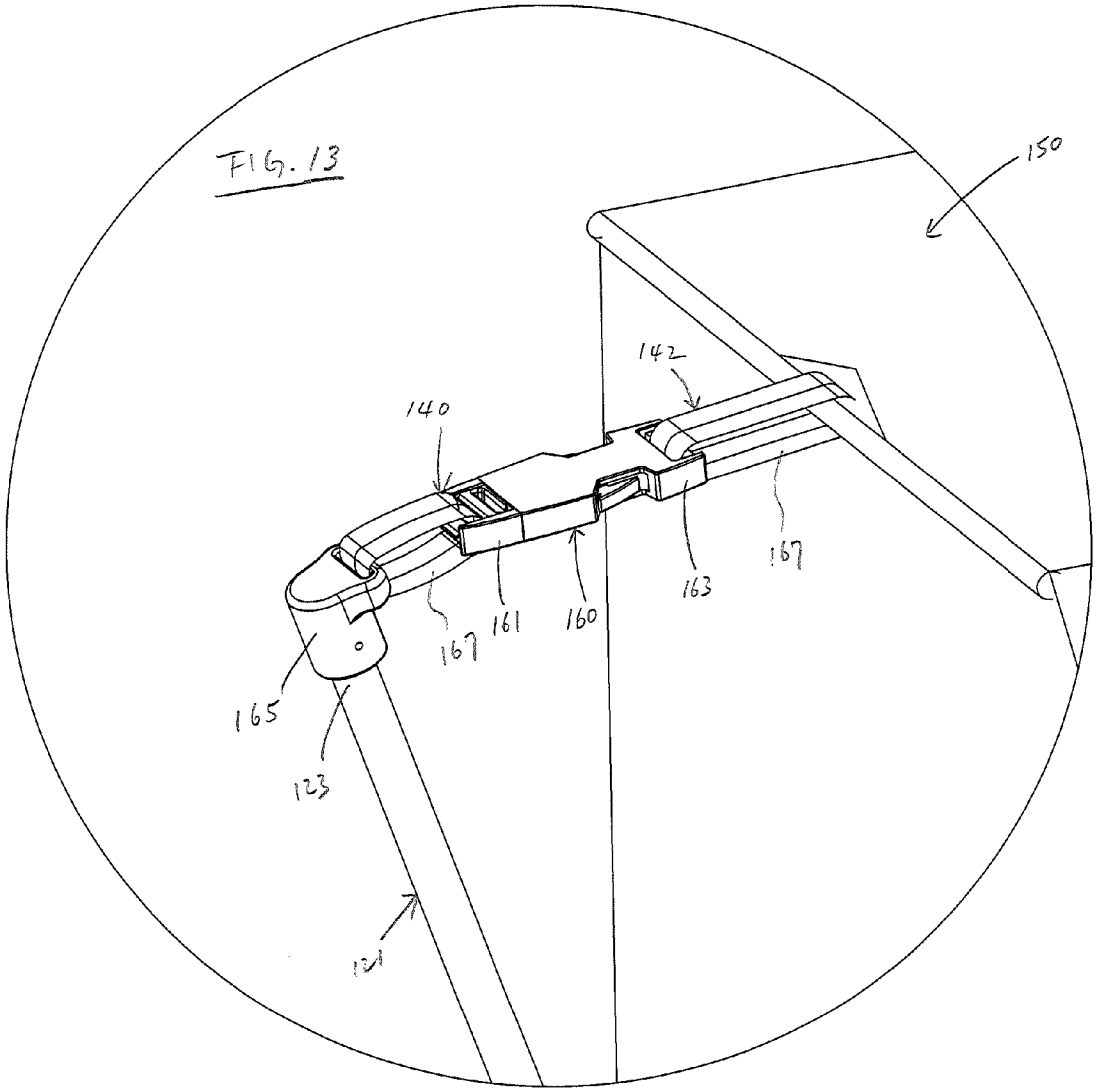
FIG. 13 is a perspective view of the first embodiment of the coupling assembly shown in FIG. 9.

Referring to FIGS. 9-11 and 13-18B, several embodiments of a coupling assembly of the present invention are shown. Referring to FIGS. 9 and 13, in a first embodiment, the coupling assembly is a conventional buckle assembly 160 in which the first coupling member 140 includes a male component 161 and the second coupling member 142 includes a female component 163. Referring to FIG. 13, the male component 161 is coupled to a first cap 165 on the vertical support top end 123 by a first loop 167. The female component 163 is coupled to the tent 150 also by first loop 167 as described above with respect to the second coupling member 142. The first loop 167 is constructed of the same material as the tent 150, i.e., a fabric constructed from materials such as cotton, polyester or nylon, or any combination thereof, but could also be constructed of other materials such as woven polyester webbing.

Referring to FIG. 10, in a second embodiment 170, the first coupling member 140 is a second cap 171 having a hook portion fixedly attached to the vertical support top end 123. The second coupling member 142 is a second loop 173 extending from the tent 150 which is attached to the tent 150 as described above with respect to the second coupling member 142.

Figure 14:
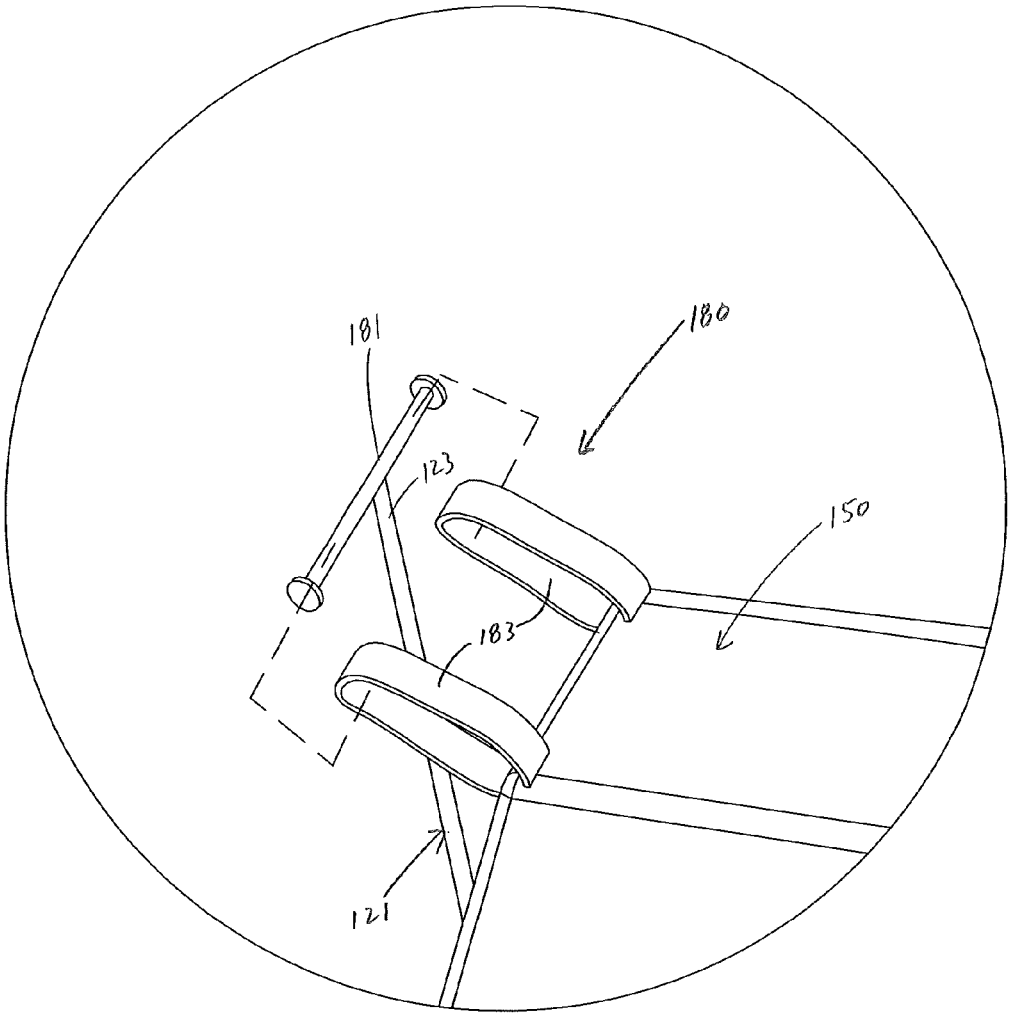
FIG. 14 is an exploded view of the third embodiment of the coupling assembly shown in FIG. 11.

Referring to FIGS. 11 and 14, in a third embodiment 180, the first coupling member 140 is a laterally extending bar 181 extending from the vertical support top end 123. In this embodiment, the laterally extending bar 181 extends on opposing sides of the vertical support 121 but the construction could be modified to extend only on one side. The second coupling member 142 is a pair of third loops 183 extending from the tent 150 which are attached to the tent 150 as described above with respect to the second coupling member 142.

Referring to FIGS. 11 and 15-18B, in the fourth and fifth embodiments 190, 192, the first coupling member 140 includes a housing 191 having a front wall 193*a* and an opposing back wall (not shown) extending between a first side wall 195*a* and an opposing second side wall (not shown). The front wall 193*a*, back wall, first side wall 195*a* and second side wall extend between a top wall 197*a* and an opposing bottom wall (not shown). First and second slots 199*a*, 199*b* are formed within the housing 191 and each slot 199*a*, 199*b* includes opposing inner and outer ends extending between the first side wall 195*a* and the second side wall. The inner end of the first slot 199*a* partially extends toward the first side wall 195*a* while fully extending through the top wall 197*a* and the bottom wall to form an opening 194, and the outer end of the first slot 199*a* fully extends through the top wall 197*a* and an upper portion of the second side wall while partially extending toward the bottom wall. An engaging surface 196 is formed below the outer end of the first slot 199*a*. In the fourth embodiment 190, an aperture (not shown) extends through a center portion of the back wall. In the fifth embodiment 192, apertures extend through a center portion of the back wall and the front wall 193*a*. In both embodiments, the aperture(s) are substantially aligned with the opening 194. The second slot 199*b* is positioned adjacent to the first slot 199*a* in inverse orientation with respect to the first wall 195*a* and the second side wall.

Figure 15:
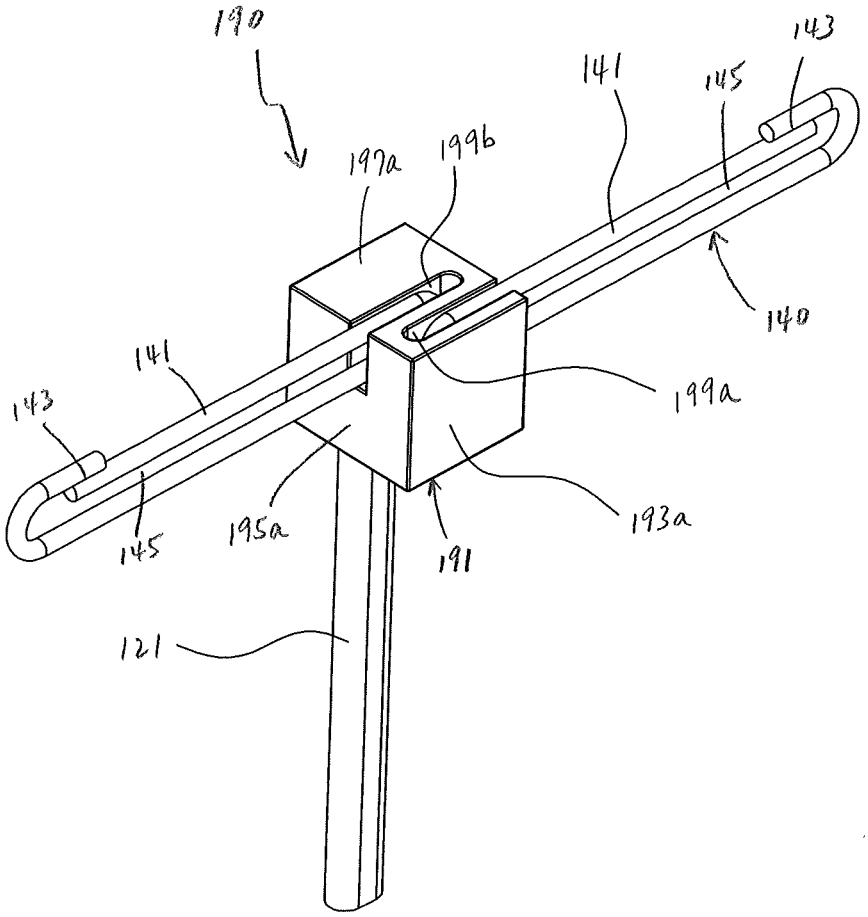
FIG. 15 is a perspective view of a coupling member of the fourth embodiment of the coupling assembly shown in FIG. 11 in an engaged state.
Figure 16:
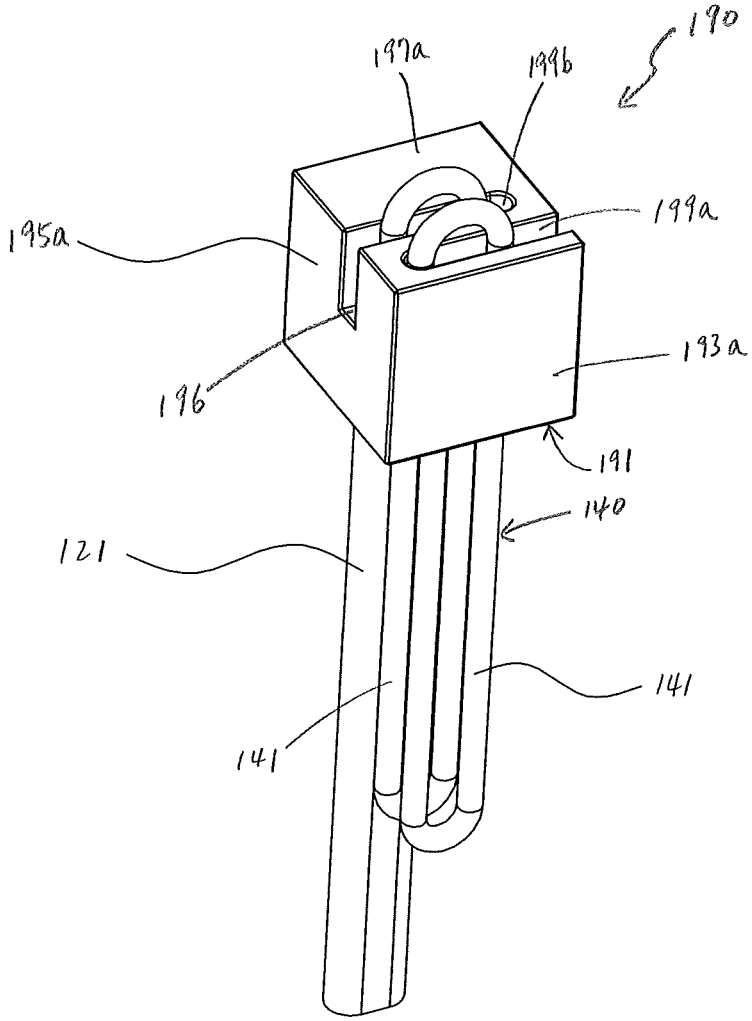
FIG. 16 is a perspective view of the coupling member of FIG. 15 in a disengaged state.

Referring again to FIGS. 11 and 15-18B, a pair of engaging members 141 having an inner end and an outer end are partially housed within the slots 199*a*, 199*b*. In the present embodiments, the engaging member 141 is a solid coil constructed of a metal or hard molded plastic, and is formed such that opposing ends of the coil overlap at an outer end to form a clip portion 143 and a channel 145 extending between the inner and outer ends. One of ordinary skill in the art will recognize that a single engaging member 141 could be used without departing from the spirit and scope of the invention. A fastener 147 extends through the back wall (and front wall 193*a* in the fifth embodiment 192), aperture(s), openings 194 and channels 145 such that the engaging members 141 are pivotally coupled to the housing 191. In the fourth embodiment 190, as shown in FIGS. 15 and 16, the back wall is extended such that the vertical support 121 top end is attached to a bottom portion of the housing 191 through the extended portion via the fastener 147. In the fifth embodiment 192, the vertical support top end 123 could be attached to the front wall 193*a* or the back wall via the fastener 147. The engaging members 141 could also be used as an auxiliary device, for example, to hang clothing items.

Referring to FIG. 11, the second coupling member 142 is a pair of fourth loops 198 extending from the tent 150 which are attached to the tent 150 as described above with respect to the second coupling member 142. One of ordinary skill will recognize that a single loop could be used on each end of the tent 150. Thus, the fourth loops 198 are inserted through the clip portions 143 to attach the tent or shelter 150 to the vertical support 121.

Referring to FIGS. 15, 17A and 17B, in an engaged state the engaging member 141 is extended laterally such that the engaging member inner end is positioned within each slot 199*a*, 199*b* and engaged with the engaging surface 196. Referring to FIGS. 16, 18A and 18B, in a disengaged state each engaging member 141 is pivoted 90 degrees and extended longitudinally through each corresponding slot inner end opening 194 such that the engaging member inner end extends below the bottom wall.

Referring to FIG. 9-11, in an expanded configuration the two connecting rods 111 are longitudinally aligned with each other, the X-shaped support racks 102, 106, support rods 104 and the vertical supports 121 are fully extended, and corresponding first and second coupling members 140, 142 are engaged. Referring to FIG. 12, in a collapsed configuration the first and second coupling members 140, 142 are disengaged and the vertical supports 121 are retracted. The X-shaped support racks 102, 106 are collapsed, and the outer X-shaped support racks 106, two connecting rods 111, and the vertical supports 121 are folded inward and substantially parallel and adjacent to each other as shown for example in FIG. 8.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A foldable tent-cot comprising:

a cot frame comprising:

two elongated rods each having a pair of connecting rods, each elongated rod having a pair of outer ends and a central portion intermediate thereto, each pair of connecting rods being pivotally connected together at the central portion by a connecting member;

a pair of outer leg assemblies, each outer leg assembly comprising: an outer X-shaped support rack, each outer X-shaped support rack pivotally connected to opposing elongated rod outer ends; and at least one support rod having a proximal end and a distal end, the proximal end of the at least one support rod pivotally connected to at least one of the elongated rods and the distal end of the at least one support rod pivotally connected to at least one of the outer X-shaped support racks; and a central X-shaped support rack pivotally connected with opposing connecting members at central portions of the opposing elongated rods, each X-shaped support rack defined by a pair of support legs that intersect adjacently at an intersection point;

a tent frame having a pair of vertical supports, each vertical support having a top end and a bottom end, each vertical support connected to a corresponding outer leg assembly, top ends of each vertical support having a first coupling member; and a tent having a floor and a plurality of walls extending upwardly therefrom to form an enclosure, the floor fixedly attached to the elongated rods, a pair of second coupling members extending from the walls for coupling to the first coupling members of the vertical supports to form a coupling assembly;

wherein in an expanded configuration the two connecting rods of each elongated rod are longitudinally aligned with each other, the X-shaped support racks and the vertical supports are fully extended, and corresponding first and second coupling members are engaged; and in a collapsed configuration the two connecting rods of each elongated rod, the X-shaped support racks and the vertical supports are collectively folded inward and substantially parallel and adjacent to each other.

2. The foldable tent-cot of claim 1, wherein the at least one support rod distal end is connected to a lower portion of the at least one of the outer X-shaped support racks.

3. The foldable tent-cot of claim 1, wherein the pair of support legs of each X-shaped support rack are pivotally coupled at each respective intersection point.

4. The foldable tent-cot of claim 1, wherein each vertical support comprises at least two sections.

5. The foldable tent-cot of claim 4, wherein the vertical support sections are telescopically retractable.

6. The foldable tent-cot of claim 1, wherein the coupling assembly is selected from a group comprising: (a) a hook coupled to at least one loop; (b) a laterally extending bar coupled to at least one loop; (c) a pivotable hook coupled to at least one loop; and (d) a buckle assembly.

7. The foldable tent-cot of claim 1, further comprising a coupling sleeve coupled to the cot frame, the coupling sleeve configured to receive the at least one vertical support such that the intermediate portion of the vertical support is slidable within the coupling sleeve between the expanded configuration and the collapsed configuration.

8. The foldable tent-cot of claim 7, wherein the coupling sleeve is coupled to the outer leg assembly.

9. The foldable tent-cot of claim 1, further comprising a pair of braces, each brace having a first end and a second end, the first ends of each brace pivotally connected to the bottom end of the vertical support, the second ends of each brace pivotally connected to the outer leg assembly.

10. A foldable tent-cot comprising:

a cot frame comprising:

two elongated rods each having a pair of connecting rods, each elongated rod having a pair of outer ends and a central portion intermediate thereto, each pair of connecting rods being pivotally connected together at the central portion by a connecting member;

a pair of outer leg assemblies, each outer leg assembly comprising: an outer X-shaped support rack, each outer X-shaped support rack pivotally connected to opposing elongated rod outer ends; and a central X-shaped support rack pivotally connected with opposing connecting members at central portions of the opposing elongated rods, each X-shaped support rack defined by a pair of support legs that intersect adjacently at an intersection point;

a tent frame having a pair of vertical supports, each vertical support having a top end and a bottom end, each vertical support connected to a corresponding outer leg assembly, top ends of each vertical support having a first coupling member, wherein each of the vertical supports is slidingly coupled to the intersection point of a corresponding outer X-shaped support rack; and a tent having a floor and a plurality of walls extending upwardly therefrom to form an enclosure, the floor fixedly attached to the elongated rods, a pair of second coupling members extending from the walls for coupling to the first coupling members of the vertical supports to form a coupling assembly;

wherein in an expanded configuration the two connecting rods of each elongated rod are longitudinally aligned with each other, the X-shaped support racks and the vertical supports are fully extended, and corresponding first and second coupling members are engaged; and in a collapsed configuration the two connecting rods of each elongated rod, the X-shaped support racks and the vertical supports are collectively folded inward and substantially parallel and adjacent to each other.

11. The foldable tent-cot of claim 10, further comprising a pair of braces, each brace having a first end and a second end, the first ends of each brace pivotally connected to the vertical support, the second ends of each brace pivotally connected to opposing support legs of a corresponding outer X-shaped support rack.

12. The foldable tent-cot of claim 10, wherein the pair of support legs of each X-shaped support rack are pivotally coupled at each respective intersection point.

13. The foldable tent-cot of claim 10, wherein each vertical support comprises at least two sections.

14. The foldable tent-cot of claim 13, wherein the vertical support sections are telescopically retractable.

15. The foldable tent-cot of claim 10, wherein the coupling assembly is selected from a group comprising: (a) a hook coupled to at least one loop; (b) a laterally extending bar coupled to at least one loop; (c) a pivotable hook coupled to at least one loop; and (d) a buckle assembly.

16. The foldable tent-cot of claim 10, further comprising a coupling sleeve coupled to the cot frame, the coupling sleeve configured to receive the at least one vertical support such that the intermediate portion of the vertical support is slidable within the coupling sleeve between the expanded configuration and the collapsed configuration.

17. The foldable tent-cot of claim 16, wherein the coupling sleeve is coupled to the outer leg assembly.

* * * * *